US009397390B2

(12) United States Patent
Lee et al.

(10) Patent No.: US 9,397,390 B2
(45) Date of Patent: Jul. 19, 2016

(54) TERMINAL HAVING HF TRANSMISSION LINE USING PRINTED CIRCUIT BOARD

(71) Applicant: GIGALANE CO., LTD., Gyeonggi-do (KR)

(72) Inventors: Yong Goo Lee, Seoul (KR); Kyung Hun Jung, Seoul (KR); Kwang Seok Choi, Gyeonggi-do (KR); Hee Seok Jung, Gyeonggi-do (KR)

(73) Assignee: GIGALANE CO., LTD., Gyeonggi-Do (KR)

( * ) Notice: Subject to any disclaimer, the term of this patent is extended or adjusted under 35 U.S.C. 154(b) by 160 days.

(21) Appl. No.: 14/173,229

(22) Filed: Feb. 5, 2014

(65) Prior Publication Data

US 2014/0225806 A1 Aug. 14, 2014

(30) Foreign Application Priority Data

Feb. 13, 2013 (KR) ..... 10-2013-0015448

(51) Int. Cl.
*H01Q 1/00* (2006.01)
*H01Q 1/36* (2006.01)
*H01Q 1/24* (2006.01)

(52) U.S. Cl.
CPC ..... *H01Q 1/243* (2013.01)

(58) Field of Classification Search
CPC ..... H01Q 1/243
USPC ..... 343/905, 702
See application file for complete search history.

(56) References Cited

U.S. PATENT DOCUMENTS 6,459,890 B1 * 10/2002 Kim ..... G04G 17/00 368/204
7,551,143 B2 * 6/2009 Park ..... H01Q 1/241 343/702
7,688,594 B2 * 3/2010 Muto ..... H05K 1/0219 174/254
7,983,724 B2 * 7/2011 Lee ..... H01Q 1/244 455/129
8,090,423 B2 * 1/2012 Na ..... H01Q 1/243 455/117
8,140,133 B2 * 3/2012 Jung ..... H04M 1/0214 455/566
2015/0241935 A1 * 8/2015 Jang ..... G06F 1/203 361/679.54

FOREIGN PATENT DOCUMENTS

KR 10-1153165 5/2012 ..... H05K 7/02

* cited by examiner

*Primary Examiner* — Peguy Jean Pierre
(74) *Attorney, Agent, or Firm* — Harness, Dickey & Pierce, P.L.C.

(57) ABSTRACT

Provided is a terminal including a high frequency (HF) communication line using a flexible printed circuit board (FPCB). The terminal includes a base board, a main board, an antenna, a battery, and an FPCB connected between the main board and the antenna and formed with an HF communication line for radio frequency (RF) communication. The FPCB includes a first connection formed on one end thereof and electrically connected to the main board, a second connection formed on another end thereof and electrically connected to the antenna, and a connector connecting the first connection with the second connection and bent at the right angle with the first connection and the second connection to vertically stand between the battery and the wall plate of the base board, thereby maximizing an area for the battery.

16 Claims, 26 Drawing Sheets

<SECTION A-A'>

<SECTION B-B'>

<SECTION C-C'>

TERMINAL HAVING HF TRANSMISSION LINE USING PRINTED CIRCUIT BOARD

RELATED APPLICATIONS

This application claims the benefit of Korean Patent Application No. 10-2013-0015448, filed on Feb. 13, 2013, in the Korean Intellectual Property Office, the disclosures of which are incorporated herein in their entirety by reference.

BACKGROUND

The present disclosure relates to a terminal including a high frequency (HF) transmission line using a printed circuit board.

Internal circuits of wireless communication devices are generally provided on printed circuit boards (PCBs). Such PCB technologies have been rapidly developed. Currently, there are generally used not only typical hard PCBs but also flexible PCBs (FPCBs) freely movable.

On the other hand, a coaxial cable is generally used as a high frequency (HF) line used in wireless terminals such as mobile phones, particularly, a radio frequency (RF) line. However, since an internal space of a wireless terminal is small and various kinds of circuit modules are mounted thereon, it is not easy to form a communication line using the coaxial cable in such space.

Accordingly, it is necessary to provide a transmission line capable of effectively transmitting an HF signal without noise while doing no harm on other modules. With respect to this, a structure, in which a signal is transmitted inside a wireless terminal using an FPCB, has been provided.

However, it is necessary to transmit an HF signal by using an FPCB between two parts mutually differing in height according to an arrangement of circuit modules in a wireless terminal. In this case, a separation distance occurs according to height and an uneven portion is formed when coupling with each other, thereby having a bad influence on signal transmission properties. When having a single layer, an FPCB has flexibility. However, since a height is formed by a thickness when an FPCB has a lamination structure, the FPCB is less flexible than the FPCB having the single layer and an arrangement thereof is not easy.

Also, when forming an HF transmission line and a data transmission line separately, space availability in a limited space of a mobile communication device in sync with miniaturization decreases and manufacturing costs increase according thereto.

SUMMARY

One or more embodiments of the present invention include a terminal capable of increasing space availability in a limited internal space of a mobile communication device and reducing costs for manufacturing lines by using a flexible printed circuit board (FPCB) for a high frequency (HF) communication line.

One or more embodiments of the present invention include a terminal capable of maximizing availability of an internal space by efficiently arranging an FPCB for an HF transmission line and an FPCB for a data communication line.

Additional aspects will be set forth in part in the description which follows and, in part, will be apparent from the description, or may be learned by practice of the presented embodiments.

According to one or more embodiments of the present invention, a terminal includes a base board including a flat plate and a wall plate vertically projected from left, right, top, and bottom edges of the flat plate, a first object disposed on the base board, a second object disposed on the base board, a battery disposed between the first object and the second object on the base board and supplying power to the terminal, and an FPCB connected between the first object and the second object for signal transmission therebetween. Herein, the FPCB includes a first connection formed on one end thereof and electrically connected to the first object, a second connection formed on another end thereof and electrically connected to the second object, and a connector connecting the first connection with the second connection, in which the connector is disposed to vertically stand between the battery and the wall plate of the base board.

The connector may include a first bent portion bent at a portion connected to the first connection and a second bent portion bent at a portion connected to the second connection and may be bent at the right angle with the first connection and the second connection.

The first object may be a main board disposed on the base board and controlling operations of the terminal, and the second object may be an antenna disposed on the base board and transmitting and receiving a wireless communication signal.

The FPCB may be connected between the first object and the second object and may be formed with an HF communication line for radio frequency (RF) communication. The FPCB may be further formed with a data communication line for data communication. The connector may be further formed with a keypad connected to the data communication line.

The first connection may be formed to be divided into a first-A connection formed with the HF communication line and a first-B connection formed with the data communication.

The first bent portion and the second bent portion of the FPCB may be formed to have smaller thicknesses than other areas of the FPCB.

The terminal may further include an auxiliary FPCB connected to the first object and formed with a data communication line for data communication. The auxiliary FPCB may include an auxiliary connection formed on one end and electrically connected to the first object and an auxiliary connector connected to the second connection. Herein, the auxiliary connector may include an auxiliary bent portion bent at a portion connected to the auxiliary connection and may be disposed to be bent at the right angle with the auxiliary connection and to vertically stand between the battery and the wall plate of the base board.

A keypad connected to the data communication line formed on the auxiliary FPCB may be formed on an end of the auxiliary connector, and a hole for exposing the keypad may be formed on a portion of the wall plate corresponding to a location in which the keypad is formed. The connector and the auxiliary connector may be disposed on a side of the base board to vertically stand between the battery and the wall plate while the auxiliary connector is being disposed more outwards toward the wall plate, and a portion of the connector corresponding to an area in which the keypad is formed may be disposed to be bent at the right angle and is in surface-contact with the base board.

The portion of the connector corresponding to the area, in which the keypad is formed, and bent at the right angle may be formed to have a smaller thickness than other areas of the connector. A groove having a rectangular shape to allow the connector to be contained therein may be further formed in an area of the wall plate of the base board, disposed in a direction, in which the connector is disposed.

The antenna may be configured to be separated into a first antenna and a second antenna, and the FPCB may be separated into a first FPCB connected to the main board and the first antenna and a second FPCB connected to the main board and the second antenna to be paired. The antenna may be configured to be separated into a first antenna and a second antenna, and the second connection may be formed to be separated into a second-A connection connected to the first antenna and a second-A connection connected to the second antenna.

The second connection may be connected to the antenna in a manner of a C-Clip type.

BRIEF DESCRIPTION OF THE DRAWINGS

These and/or other aspects will become apparent and more readily appreciated from the following description of the embodiments, taken in conjunction with the accompanying drawings in which:

FIGS. 7 to 15A are side views of the FPCB shown in FIG. 6B;

DETAILED DESCRIPTION

Figure 1:
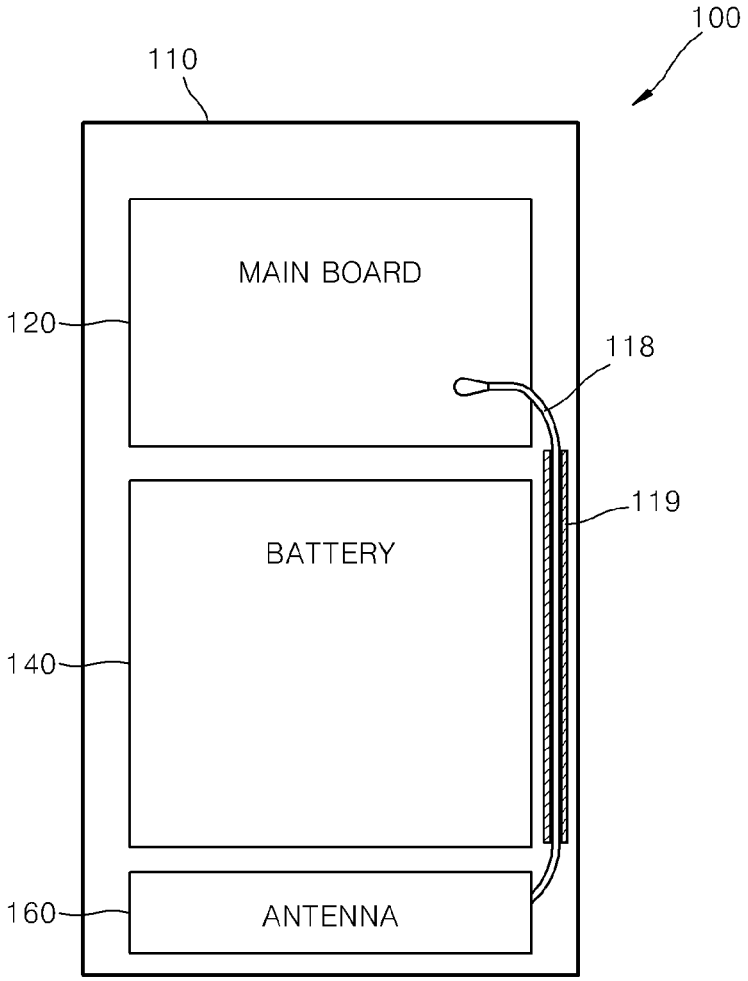
FIG. 1 is a top view illustrating an arrangement of a general terminal installed with a cable-type radio frequency (RF) communication line.

Hereinafter, exemplary embodiments of the present invention will be described in detail with reference to the attached drawings.

The embodiments of the present invention are provided to more perfectly explain the inventive concept to a person of ordinary skill in the art. The following embodiments may be changed into various other forms, and the scope of the inventive concept is not limited thereto. The embodiments are provided to allow the present disclosure to be more substantial and perfect and to fully transfer the inventive concept to those skilled in the art.

Terms used in the specification are to describe particular embodiments but will not limit the inventive concept. As used herein, the singular forms "a," "an" and "the" are intended to include the plural forms as well, unless the context clearly indicates otherwise. It will be further understood that the terms "comprises" and/or "comprising" used herein specify the presence of stated shapes, numbers, operations, elements, and/or a group thereof, but do not preclude the presence or addition of one or more other shapes, numbers, operations, elements, and/or groups thereof. As used herein, the term "and/or" includes any and all combinations of one or more of the associated listed items.

It will be understood that although the terms "first", "second", etc. may be used herein to describe various components, these components should not be limited by these terms. The terms do not mean a particular order, top and bottom, or merits and demerits but are only used to distinguish one component from another. Accordingly, a first element, area, or portion that will be described below may indicate a second element, area, or portion without deviating from teachings of the inventive concept.

Hereinafter, the embodiments of the inventive concept will be described with reference to schematic drawings. In the drawings, for example, according to manufacturing technologies and/or tolerances, illustrated shapes may be modified. Accordingly, the embodiments of the inventive concept will not be understood to be being limited to certain shapes of illustrated areas but will include variances in shapes caused while being manufactured.

FIG. 1 is a top view illustrating an arrangement of a general terminal 100 installed with a cable-type radio frequency (RF) communication line. FIG. 1 illustrates the terminal 100 installed with a general cable-type RF communication line. The terminal 100 indicates a mobile communication terminal such as a smart phone. The terminal 100 includes a base board 110, a main board disposed on the base board 110, a battery 140, an antenna 160, and an RF communication cable 118 connected to the main board 120 and the antenna 160.

The base board 110 is formed of a material such as plastic and may be formed of a flat plate on a bottom thereof and a wall plate vertically projected from left, right, top, and bottom edges of the flat plate. The main board 120 controls all operations of the terminal 100. The battery 140 supplies power to the terminal 100. The antenna 160 transmits and receives wireless communication signals.

Herein, in case of the terminal 100, since the cable-type RF communication cable 118 is connected between the main board 120 and the antenna 160, it is impossible to use a space as much as a thickness of the cable 118 on a side of the battery 140 disposed therebetween.

Particularly, to reduce a thickness of a smart phone, the RF communication cable 118 is disposed on the side of the terminal 100. A fixation frame 119 for fixing the RF communication cable 118 may be disposed on the side. In this case, a space of the side of the terminal 100, available for the battery 140, is reduced as much as the thicknesses of the RF communication cable 118 and the fixation frame 119.

Figure 2A:
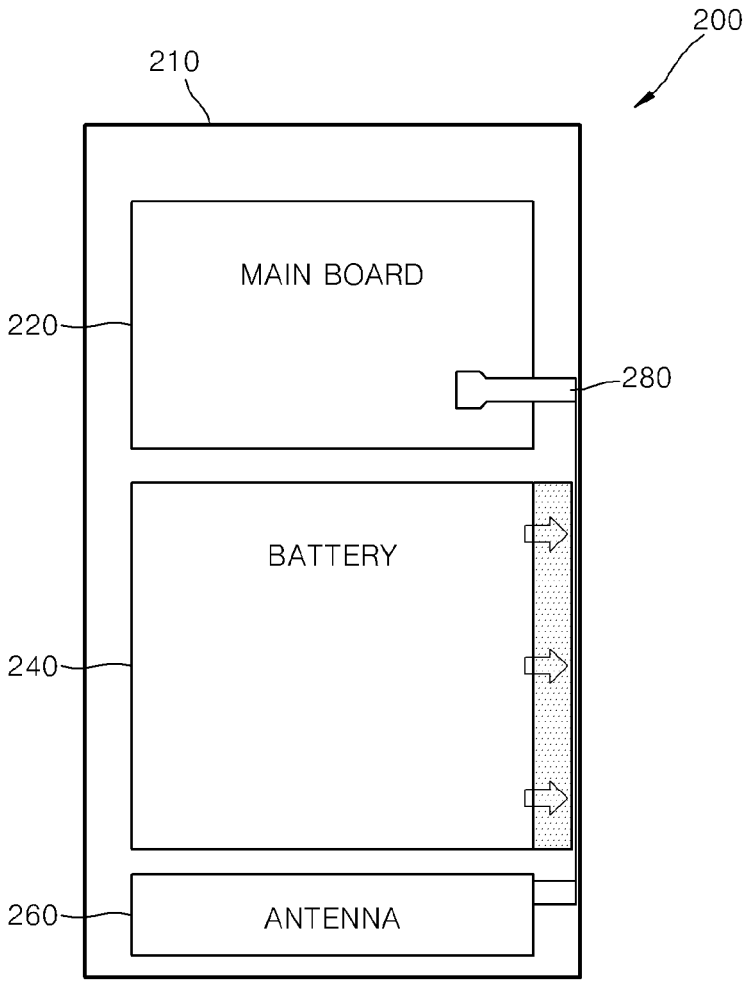
FIGS. 2A and 2B are a top view and a side view respectively illustrating an arrangement of a terminal installed with a flexible printed circuit board (FPCB) formed with a high frequency (HF) communication line according to an embodiment of the present invention.
Figure 2B:
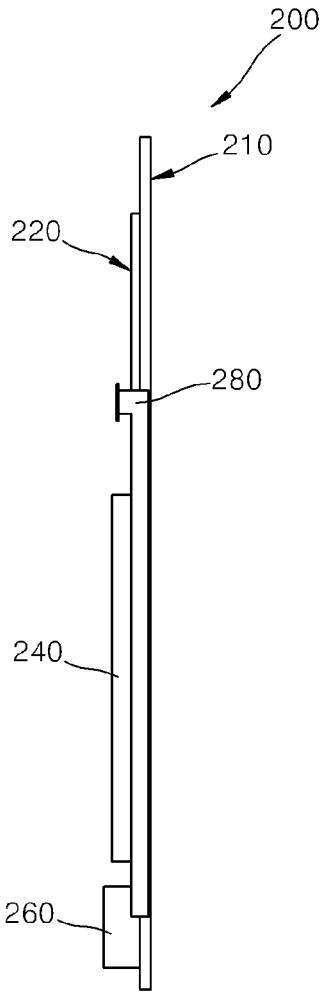

FIGS. 2A and 2B are a top view and a side view respectively illustrating an arrangement of a terminal 200 installed with a flexible printed circuit board (FPCB) 280 formed with a high frequency (HF) communication line according to an embodiment of the present invention.

In the embodiment, to solve limitations of the general terminal 100 of FIG. 1, the FPCB 280 for HF communication is disposed in the terminal 200 to perform RF communication.

Referring to FIGS. 2A and 2B, the terminal 200 includes a base board 210, a main board 220, a battery 240, an antenna 260, and the FPCB 280.

Since functions of the base board 210, the main board 220, the battery 240, and the antenna 260 are identical to those described with reference to FIG. 1, a description thereof will be omitted.

The FPCB 280 indicates a PCB having a flexible material capable of being bent and is formed as a film shape having a certain surface area. The FPCB 280 includes a first connection connected to the main board 220, a second connection connected to the antenna 260, and a connector connecting the first connection and the second connection to each other.

That is, in FIG. 2A, a portion connected to a top of the main board 220 with surface contact is the first connection, a portion connected to a bottom of the antenna 260 with surface contact, and a portion standing on a right side of the base board 210 while being bent at right angle is the connector.

In detail, a first bent portion bent at right angle may be located in a portion connected from the first connection to the connector and a second bent portion may be formed in a portion connected from the connector to the first connection.

In this case, the first bent portion and the second bent portion may be formed to be thinner than other areas of the FPCB 280 to be easily bent. Generally, the FPCB 280 has a structure deposited with a conductor layer, a dielectric layer, and a signal transmission line and may have a structure with repetitive depositions described above.

Generally, a conductor layer forming a ground is disposed on a lowermost portion, a dielectric layer is deposited thereon, a signal transmission line for transmitting an HF signal is deposited thereon, a dielectric layer is deposited on the signal transmission line, and a conductor layer is disposed thereon. The conductor layer disposed higher generally also function as a ground and may be connected to the conductor layer on the lowermost portion through a via hole.

An outermost surface of the deposition structure of the FPCB 280 as described above may be covered by a cover layer. A width of a minor axis of the signal transmission line is smaller than widths of minor axes of the conductor layer and the dielectric layer. The FPCB 280 may have a micro strip line structure or a strip line structure. Since the structure may be known to those skilled in the art, a detailed description will be omitted.

The conductor layer and the signal transmission line may be formed of a metallic material, for example, copper, silver, gold, etc. The dielectric layer may be formed of a dielectric material, for example, polyimide, liquid crystal polymer (LCP), and polytetrafluoroethylene (PTFE) In this case, the FPCB 280 has a structure deposited with the conductor layer, the dielectric layer, and the signal transmission line, in which the conductor layer disposed on an uppermost portion of the connector and the conductor layer disposed on the lowermost portion are connected to each other through the via hole of the dielectric layer, filled with a conductor. The conductor layer disposed on uppermost portions of the first bent portion and the second bent portion may be removed. According thereto, thicknesses of the first bent portion and the second bent portion may be thinner, thereby allowing the connector to vertically stand while being bent and meeting the first connection and the second connection at the right angle.

As shown in FIG. 2A, the connector of the FPCB 280 vertically stands and is located in a rightmost end of the base board 210, thereby providing an area for the battery 240 in the right side as much as possible.

Figure 3A:
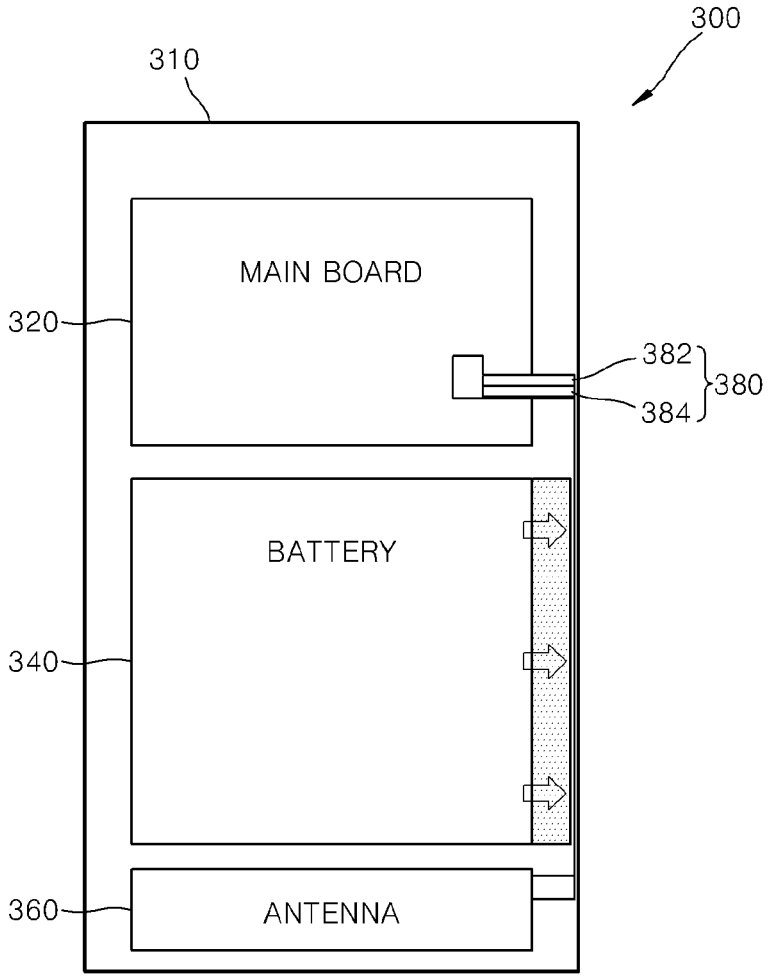
FIGS. 3A and 3B are a top view and a side view respectively illustrating an arrangement of a terminal installed with an FPCB formed with an HF communication line according to another embodiment of the present invention.
Figure 3B:
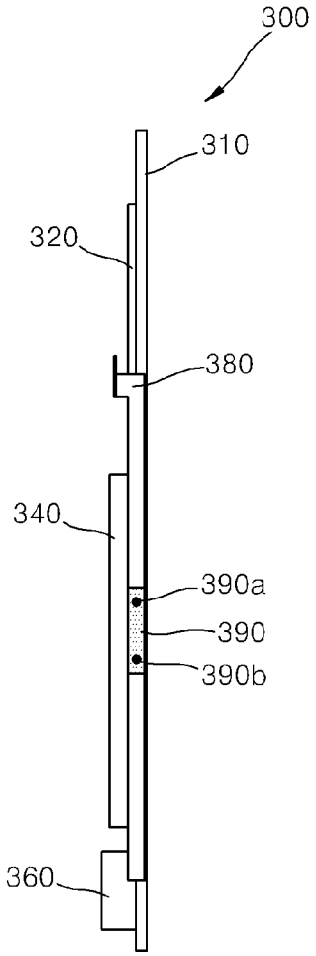

FIGS. 3A and 3B are a top view and a side view respectively illustrating an arrangement of a terminal 300 installed with an FPCB 380 formed with an HF communication line according to another embodiment of the present invention.

The terminal 300 includes a base board 310, a main board 320, a battery 340, an antenna 360, and the FPCB 380.

Except the FPCB 380, the terminal 300 has components identical to the terminal 200, hereinafter, only the FPCB 380 will be described.

The FPCB 380 includes not only an HF communication line 384 for RF communication but also a data communication line 382 for data communication. That is, the HF communication line 384 is formed to be connected to the antenna 360 and the data communication line 382 may be appropriately formed according to a location of a module for data communication.

That is, in detail, referring to FIG. 3B, a keypad 390 is formed on a side of the terminal 300. The data communication line 382 may be connected to the keypad 390. The keypad 390 may be formed of a first button 390*a* and a second button 390*b*, which may be a volume control key, etc.

Through this, when integrally forming the HF communication line 384 and the data communication line 382 on one FPCB 38, manufacturing costs may be reduced and a structure thereof may become very simplified.

Figure 4A:
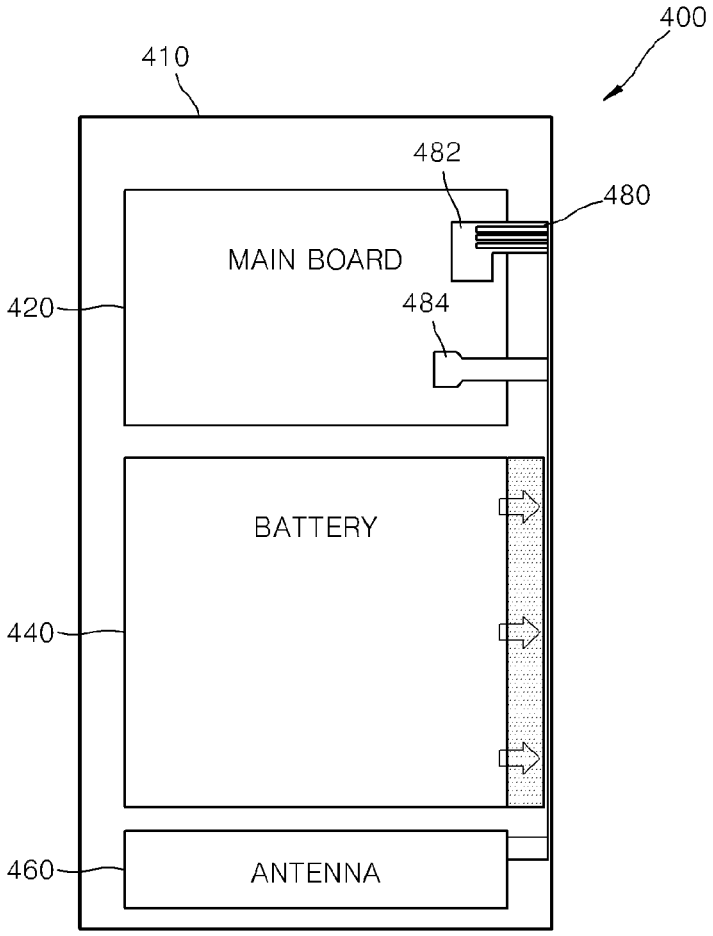
FIGS. 4A and 4B are a top view and a side view respectively illustrating an arrangement of a terminal installed with an FPCB formed with an HF communication line according to still another embodiment of the present invention.
Figure 4B:
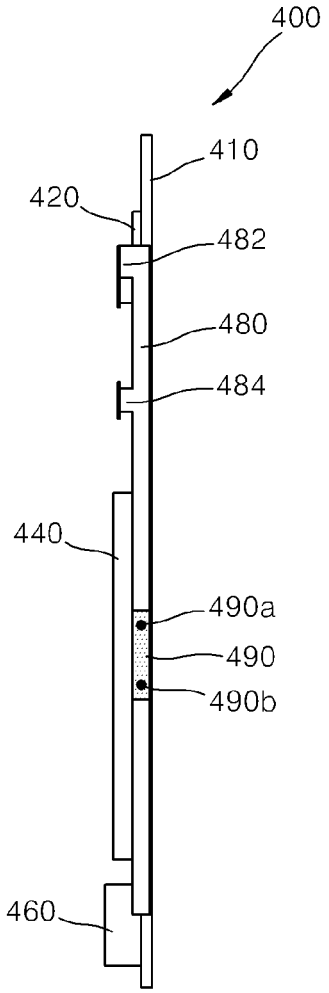

FIGS. 4A and 4B are a top view and a side view respectively illustrating an arrangement of a terminal 400 installed with an FPCB 480 formed with a high frequency communication line according to still another embodiment of the present invention.

The terminal 400 includes a base board 410, a main board 420, a battery 440, an antenna 460, and the FPCB 480.

Except the FPCB 480, the terminal 400 has components identical to the terminal 300, hereinafter, only the FPCB 480 will be described.

The FPCB 480 includes a first connection connected to the main board 420. The first connection is formed to be divided into a first-A connection 484 formed with an HF communication line and a first-B connection 482 formed with a data communication line.

The first-A connection 484 and the first-B connection 482 are bent at the right angle and connected to one connector. The connector is disposed in a right side of the base board 410 while vertically standing. Due to a structure described above, since a thickness of the FPCB 480 passing by a right side of the battery 440 is very small, the terminal 400 may maximize an area occupied by the battery 440.

Figure 5:
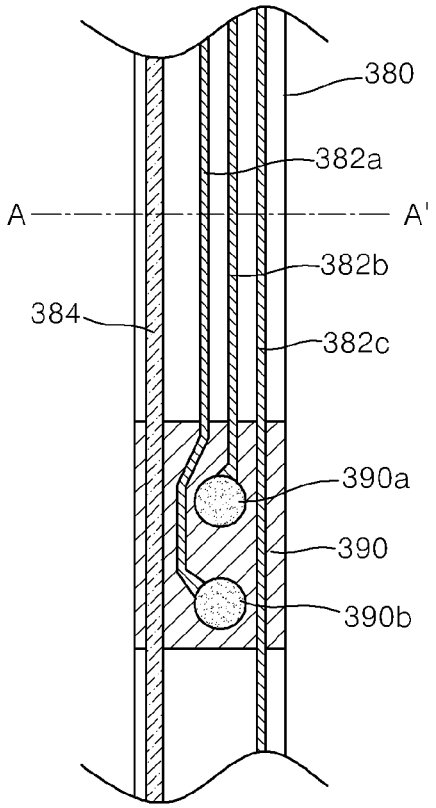
FIG. 5 is an enlarged view of a side of the FPCB of FIG. 3A formed with an HF communication line, the side being formed with a keypad.

FIG. 5 is an enlarged view of a side of the FPCB 380 formed with the HF communication line, the side being formed with a keypad 390.

In the embodiment of FIGS. 3A and 3B, the HF communication line 384 and the data communication line 382 are formed at the same time on one FPCB 380, in which a communication line may be formed on a side as shown in FIG. 5.

In a leftmost side, the HF communication line 380 is extended from top to bottom toward the antenna 360, a data communication line 382*b* is connected to the first button 390*a* of the keypad 390, and a data communication line 382*a* is connected to the second button 390*b*. In a rightmost side, a data communication line 382*c* is extended downwardly. The data communication line 382*c* indicates a data communication line connected to a separate module in addition to the keypad 390.

Figure 6A:
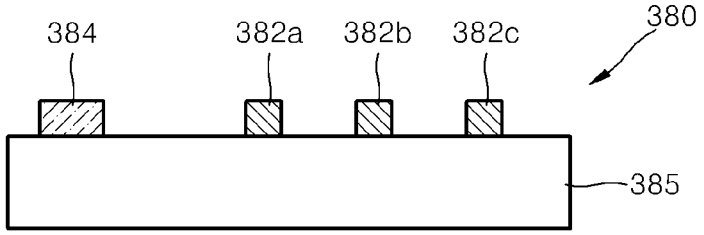
FIGS. 6A to 6C are side views respectively illustrating three examples of a part taken along a line A-A' of FIG. 5.
Figure 6B:
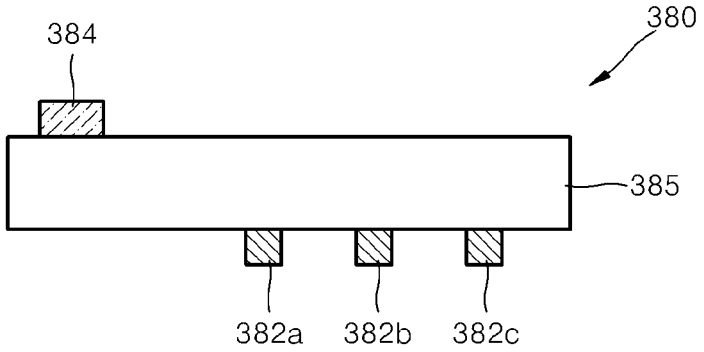
Figure 6C:
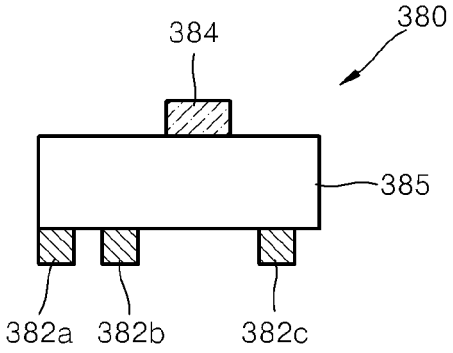

FIGS. 6A to 6C are side views respectively illustrating three examples of a part taken along a line A-A' of FIG. 5.

That is, one HF communication line 384 and three data communication lines 382*a* to 382*c* may be formed on the FPCB 380. All communication lines may be formed on a top of a board 385 as shown in FIG. 6A, or the HF communication line 384 may be formed opposite to the data communication lines 382*a* to 382*c* as shown in FIGS. 6B and 6C.

In the embodiment of FIGS. 6A to 6C, a detailed configuration of an FPCB of FIG. 6B will be described with reference to FIGS. 7 to 15 as follows.

Embodiment 1

Board Having a Metallic Shield Formed of a Via Hole

Figure 7:
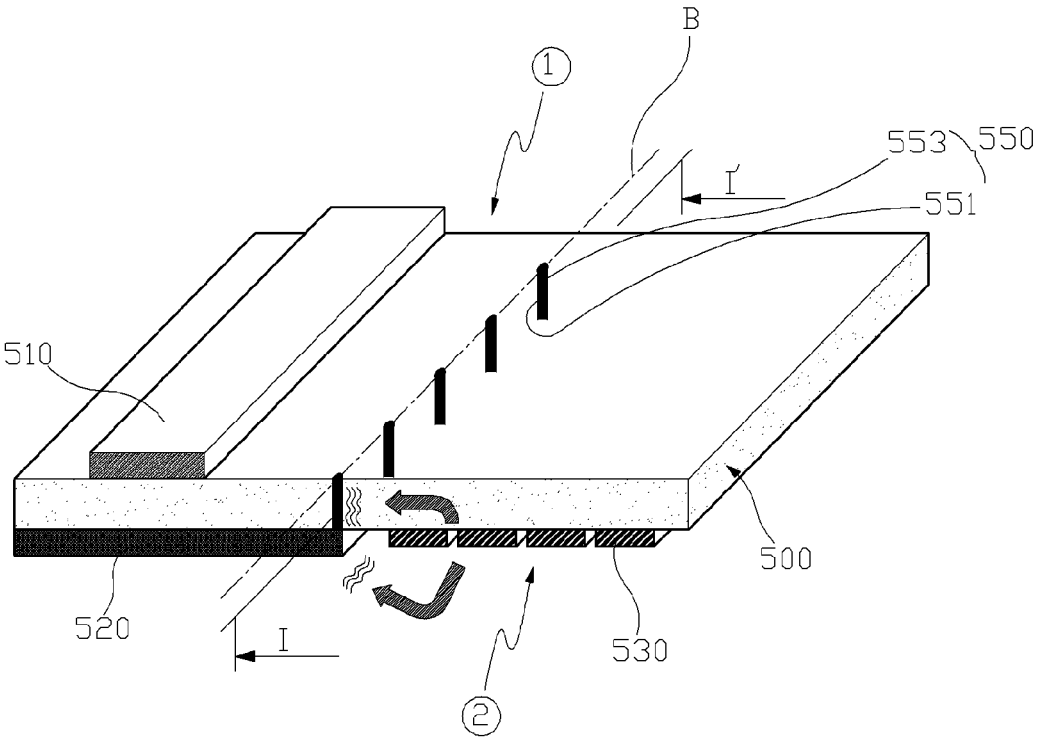

Referring to FIG. 7, a board having a metallic shield 550 formed of a via hole 551 and a metallic material 553.

The soft board for transmitting a signal includes a dielectric 500 including two different signal lines 510 and 530 forming independently separate areas ① and ② and alternately disposed with each other, the metallic shield 550 disposed on a boundary between the separate areas ① and ② with certain intervals and shielding interferences between the two different signal lines 510 and 530, and a grounded conductor layer 520 formed in a certain location of the dielectric 500 and electrically connected to the metallic shield 550.

The dielectric 500 is formed to have a certain width, thickness, and area. The dielectric 500, as shown in FIG. 7, includes two separate areas ① and ② divided by a boundary B.

The separate areas ① and ② may be formed of a first separate area ① and a second separate area ②.

On a top surface of the dielectric 500 corresponding to the first separate area ①, the HF signal transmission line 510 is formed. On a bottom surface of the dielectric corresponding to the second separate area ②, the data signal line 530 is formed. Herein, the data signal line 530 may be formed of a plurality of lines parallel to one another.

Particularly, in the embodiment, the HF signal transmission line 510 and the data signal line 530 are located alternately based on the boundary B.

Also, as shown in FIG. 7, on the bottom surface of the dielectric 500 corresponding to an opposite side of the first separate area ①, the grounded conductor layer 520 is formed. Herein, the grounded conductor layer 520 is formed to include the boundary B.

Figure 9:
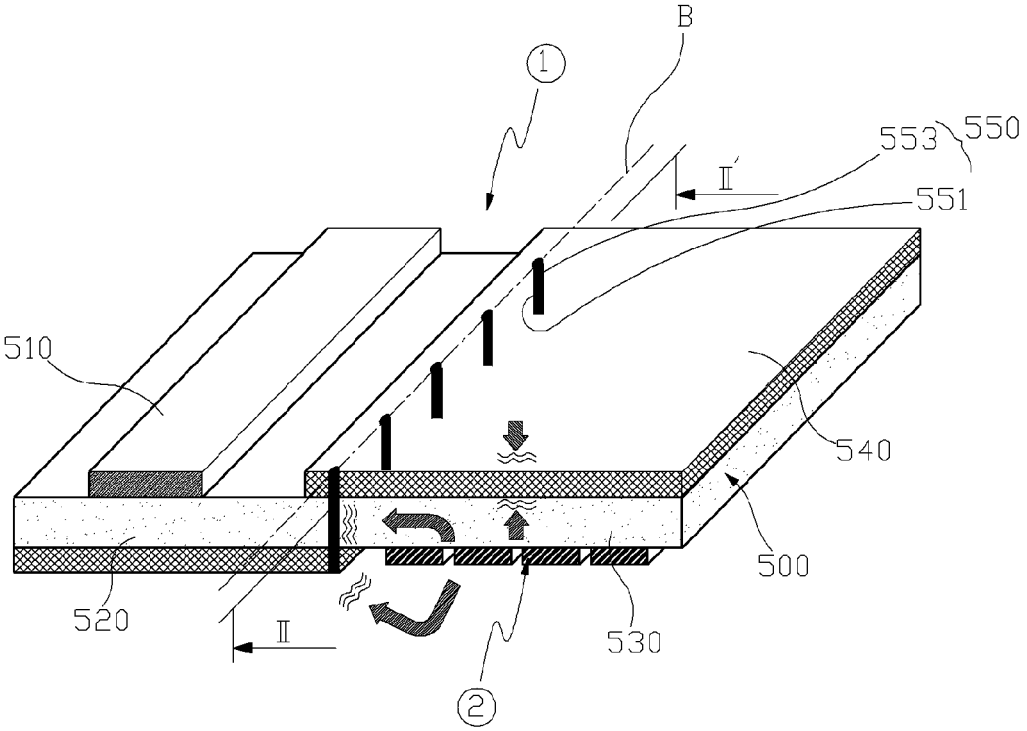
Figure 10:
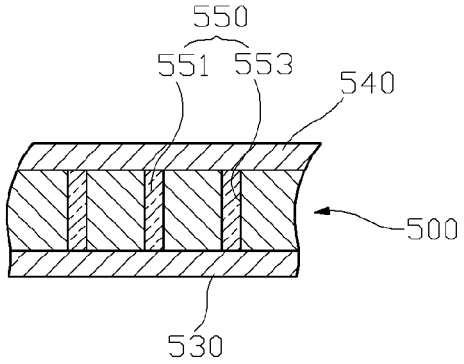

As shown in FIGS. 9 and 10, a grounded conductor layer B may include a first grounded conductor layer 520 formed on an outer surface of the dielectric 500 located on the opposite side of the first separate area ① to include the boundary B and a second grounded conductor layer 540 formed on another outer surface of the dielectric 500 located on an opposite side of the second separate area ② to include the boundary B.

Figure 8:
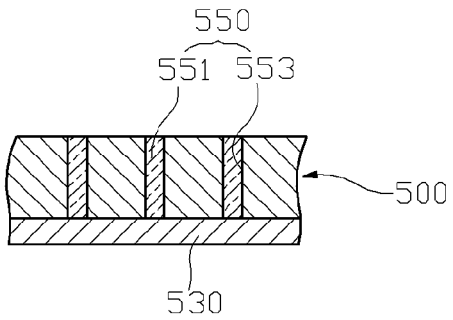

Referring to FIGS. 7 and 8, the metallic shields 550 are formed along the boundary B dividing the separate areas ① and ② with certain intervals and are electrically connected to the grounded conductor layer 540.

In more detail, the metallic shield 550 includes a plurality of via holes 551 penetrating the dielectric 500 along the boundary B with certain intervals and the metallic material 553 inserted into the via holes 551.

Herein, the metallic material 553 may be copper, which may be inserted into the via holes 551 or may form a thin copper film on an inner circumference of each of the via holes 551.

Accordingly, on the dielectric 500, the HF signal transmission line 510 located in the first separate area ① and the data signal line formed in the second separate area ②, located alternately with the first separate area ① based on the boundary B may be easily isolated by the metallic shield 550 electrically connected to the grounded conductor layer 520 while forming a certain interval on the boundary B.

Figure 15A:
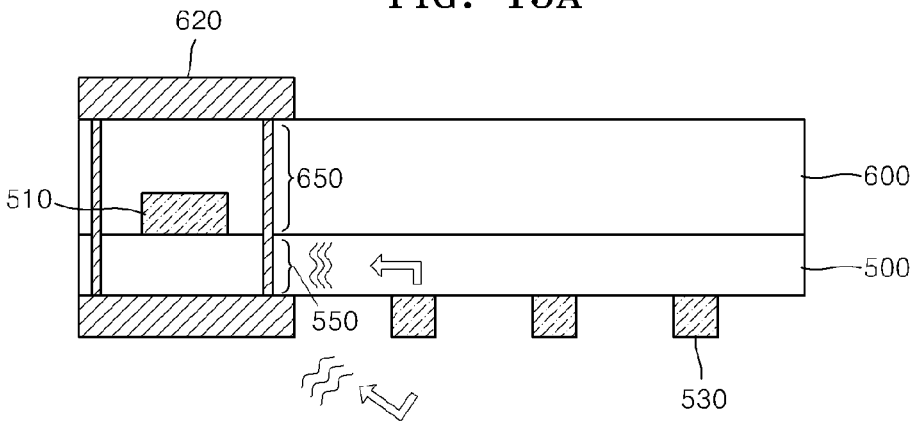

Also, as shown in FIG. 15*a*, in order to protect HF signal transmission line 510, the configuration of FIG. 7 may further include an additional dielectric 600 on a top surface of the HF signal transmission line 510. On a top surface of the dielectric 600, a grounded conductor layer 620 may be further formed. To both left and right end portions of the grounded conductor layer 620, metallic shields 650 formed of via holes and metallic material, respectively, are connected. The metallic shield 650 may be connected to the metallic shield 550 formed in the dielectric 500.

Figure 15B:
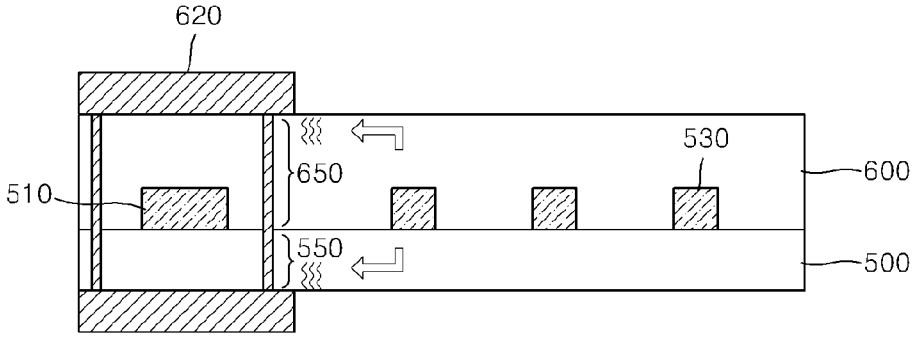
FIG. 15B is a side view of the FPCB according to a modified example shown in FIG. 15A.

FIG. 15B is a modified example of FIG. 15A and is identical to FIG. 15A except that the data signal line 530 is not located on the bottom surface of the dielectric 500 but is formed on the top surface of the dielectric 500. That is, in FIG. 15B, both the HF signal transmission line 510 and the data signal line 530, which are two different signal lines, are configured to be buried between the dielectric 500 and the dielectric 600. Since other components are identical, a detailed description will be omitted.

Also, as shown in FIGS. 9 and 10, the metallic shield 550 may be configured to be electrically connected to the first grounded conductor layer 520 and the second grounded conductor layer 540.

That is, a noise occurring in the data signal line 530 is not transferred to the first separate area ①, thereby transmitting an HF signal through the HF signal transmission line 510 while being without interference caused by external noises.

Embodiment 2

Board Having a Metallic Shield Formed as Panel Shape

Figure 11:
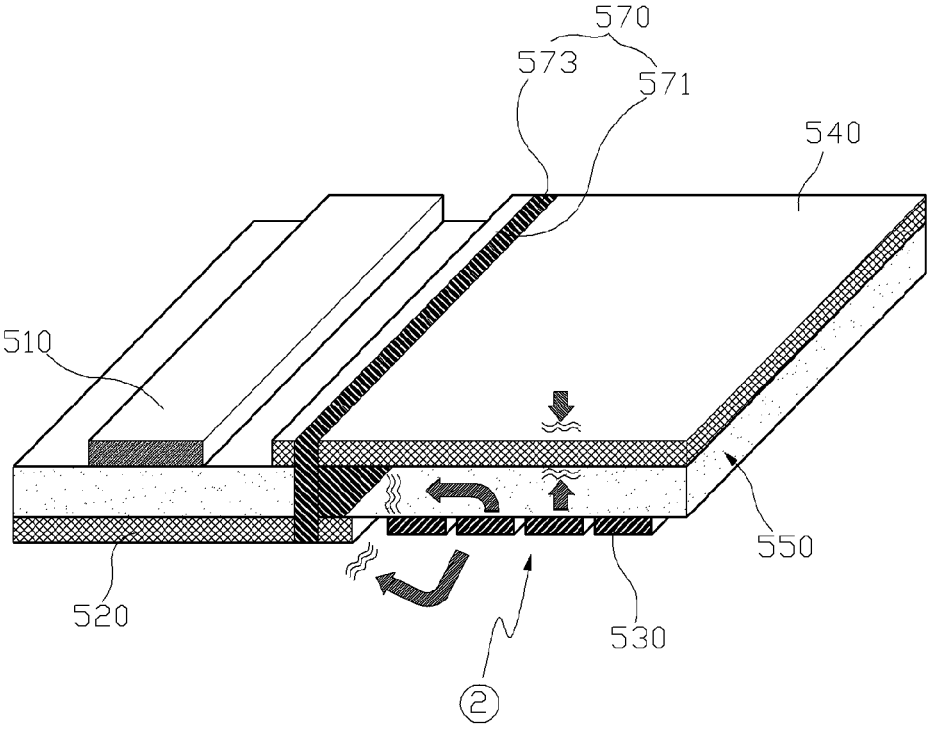

Referring to FIG. 11, a metallic shield 570 formed as a panel shape will be described.

The soft board for transmitting a signal includes a dielectric 500 including different signal lines 510 and 530 forming independently separate areas ① and ② and alternately disposed with each other, the metallic shield 570 disposed on a boundary between the separate areas ① and ② with certain intervals and shielding interferences between the different signal lines 510 and 530, and grounded conductor layers 520 and 540 formed in certain locations on the dielectric 500 and electrically connected to the metallic shield 570.

The dielectric 500 is formed to have a certain width, thickness, and area. The dielectric 500, as shown in FIG. 11, includes two separate areas ① and ② divided by a boundary B.

The separate areas ① and ② may be formed of a first separate area ① and a second separate area ②. On a top surface of the dielectric 500 corresponding to the first separate area ①, the HF signal transmission line 510 is formed. On a bottom surface of the dielectric corresponding to the second separate area ②, the data signal line 530 is formed. Herein, the data signal line 530 may be formed of a plurality of lines parallel to one another.

Particularly, in the embodiment, the HF signal transmission line 510 and the data signal line 530 are located alternately based on the boundary B.

As shown in FIGS. 11 and 10, the grounded conductor layers 520 and 540 may include a first grounded conductor layer 520 formed on an outer surface of the dielectric 500 located on the opposite side of the first separate area ① to include the boundary B and a second grounded conductor layer 540 formed on another outer surface of the dielectric 500 located on an opposite side of the second separate area ② to include the boundary B.

The metallic shield 570 may be formed, for example, as a panel buried in the boundary B. The metallic shield 570 may be formed by forming an incision hole 571 penetrating the dielectric 500 while having a certain width along the boundary B to form a panel shape and filling the incision hole 571 with a metallic material 573. In this case, the metallic material 573 may be copper.

Accordingly, on the dielectric 500, the HF signal transmission line 510 located in the first separate area ① and the data signal line formed in the second separate area ②, located alternately with the first separate area ① based on the boundary B may be easily isolated by the metallic shield 570 having a panel shape formed of copper and electrically connected to the grounded conductor layer 520 and 540 while forming a certain interval on the boundary B.

That is, a noise occurring in the data signal line 530 is not transferred to the first separate area ①, thereby transmitting an HF signal through the HF signal transmission line 510 while being without interference caused by external noises.

Embodiment 3

Board Having Shield Film

Figure 12:
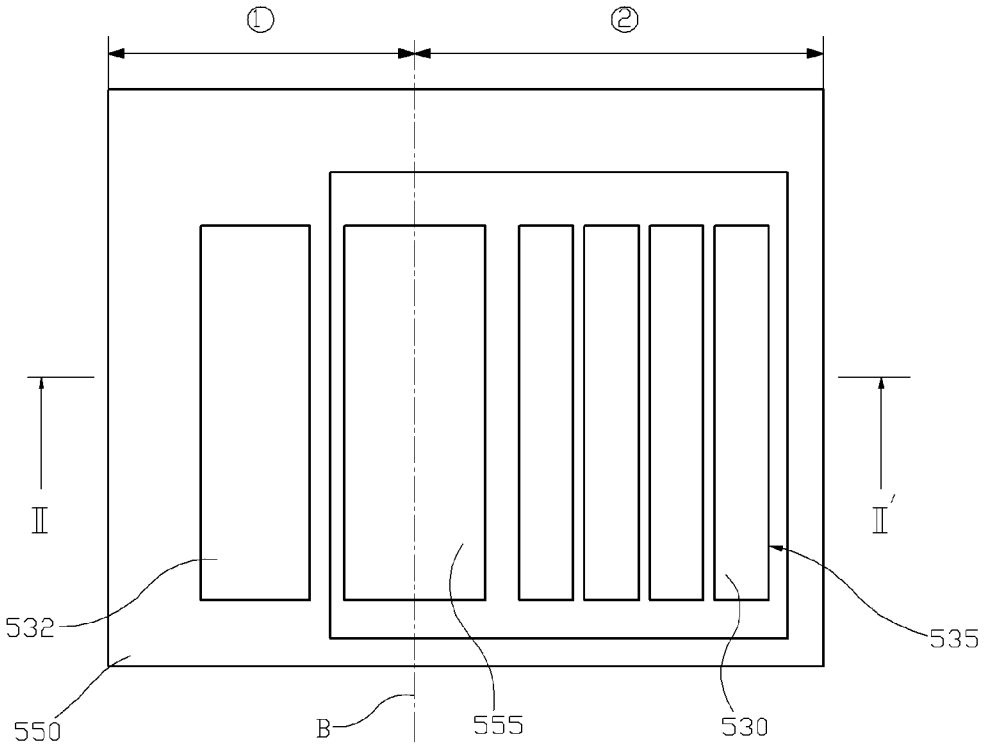
Figure 13:
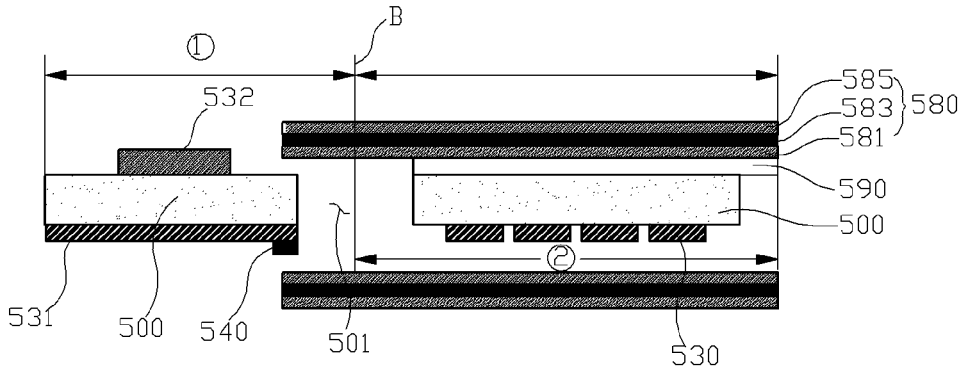
Figure 14:
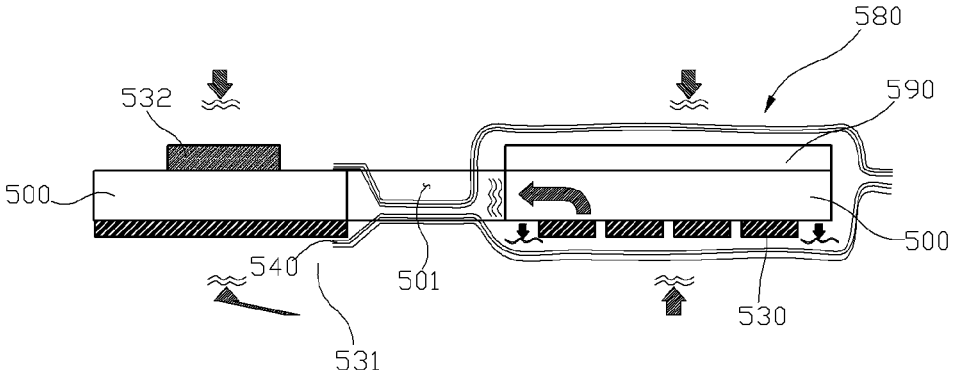

Referring to FIGS. 12 to 14, a board having a shielding film 580 will be described.

Referring to FIGS. 12 to 14, the soft signal transmission board includes a dielectric 500 including different signal lines 532 and 530 forming independently separate areas ① and ② and alternately disposed with each other, a space 555 formed on the boundary B formed between the separate areas ① and ② and penetrate top and bottom of the dielectric 500, a pair of grounded conductor layers 540 and 590 formed on one surface of the dielectric 500, opposite to the respective separate areas ① and ②, and the shielding film 580 closely attached to top and bottom surfaces of the dielectric 500 on a top and bottom of the dielectric 500, surrounding one of the space 555 and the separate areas ① and ②, and shielding interferences between the two different signal lines 532 and 530.

In this case, the two different signal lines 532 and 530 include an HF signal transmission line 532 for transmitting an HF signal and a data signal line 530 for transmitting a data signal, the separate areas ① and ② include a first separate area ① formed with the HF signal transmission line 532 and the second separate area ② formed with the data signal line 300, the boundary B is formed between the first separate area ① and the second separate area ②, and the shielding film 580 may surround the second separate area ②.

Also, a conductor layer 531 forming a ground may be further formed on one surface of the dielectric 500 opposite to the first separate area ①.

Also, the shielding film 580 is formed as a pair to be disposed on top and bottom of the dielectric 500, respectively, and may include an adhesive layer 581 adhered to the one surface of the dielectric 500 and a protection film layer 585 formed on an outer surface of the adhesive layer 581.

Particularly, in the embodiment, a silver powder layer 583 formed of silver powder may be further formed between the adhesive layer 581 and the protection film layer 585.

A process of forming the space 555 and the shielding film 580 on the board having the shielding film 580 will be described.

The HF signal transmission line 532 is formed on a top of the dielectric 500, and the data signal line 530 is formed on a bottom of the dielectric 500, alternately to the HF signal transmission line 532. According thereto, between the first separate area ① formed with the HF signal transmission line 532 and the second separate area ② formed with the data signal line 530, the boundary B dividing the areas may be formed.

Sequentially, the dielectric 500 is perforated to form a certain width and length in a location of the boundary B. A hole formed by perforating is the space 555. According thereto, the first separate area ① and the second separate area ② may be divided by the space 555.

Also, in the first separate area ① adjacent to the space 555 and the second separate area ② and on the bottom of the dielectric 500 opposite to the second separate area ② adjacent to the space 555, metallic conductor layers 540 and 590 are formed.

Also, the shielding film 580 is prepared. The shielding film 580 is a flexible film formed of the adhesive layer 581 and the protection film layer 585 formed on the outer surface of the adhesive layer 581.

A pair of the shielding films 580 is prepared and is located on the top and bottom of the dielectric 500.

Sequentially, one side of the pair of shielding films 580 is attached to the second separate area ② and the bottom of the dielectric 500 opposite thereto and another side of the pair of shielding films 580 is attached to the first separate area ① and the bottom of the dielectric 500 opposite thereto to cover top and bottom of the space 555. According thereto, the space 555 may be shielded by the shielding film 580.

Also, in the shielding film 580, between the adhesive layer 581 and the protection film layer 585, the silver powder layer 583 is further formed by applying silver powder, thereby shielding a noise interference between the first and second separate areas ① and ②.

Accordingly, the data signal line 530 in the second separate area ② is surrounded by the shielding film 580, thereby easily isolated from the HF signal transmission line 532 in the first separate area ①.

In addition thereto, in the embodiment, silver powder may be vapor-deposited in an area to be attached with the shielding film 580 by sputtering instead of the shielding film 580.

Accordingly, the HF signal transmission line 532 located in the first separate area ① and the data signal line 530 formed in the second separate area ② located alternately with the first separate area ① based on the boundary B may be easily isolated from each other by the space 555 in the boundary B covered by the shielding film 580 or the silver powder vapor-deposited on the periphery of the space 555.

That is, a noise occurring in the data signal line 530 is not transferred to the first separate area ①, thereby transmitting an HF signal through the HF signal transmission line 532 without interference caused by an external noise.

Figure 16A:
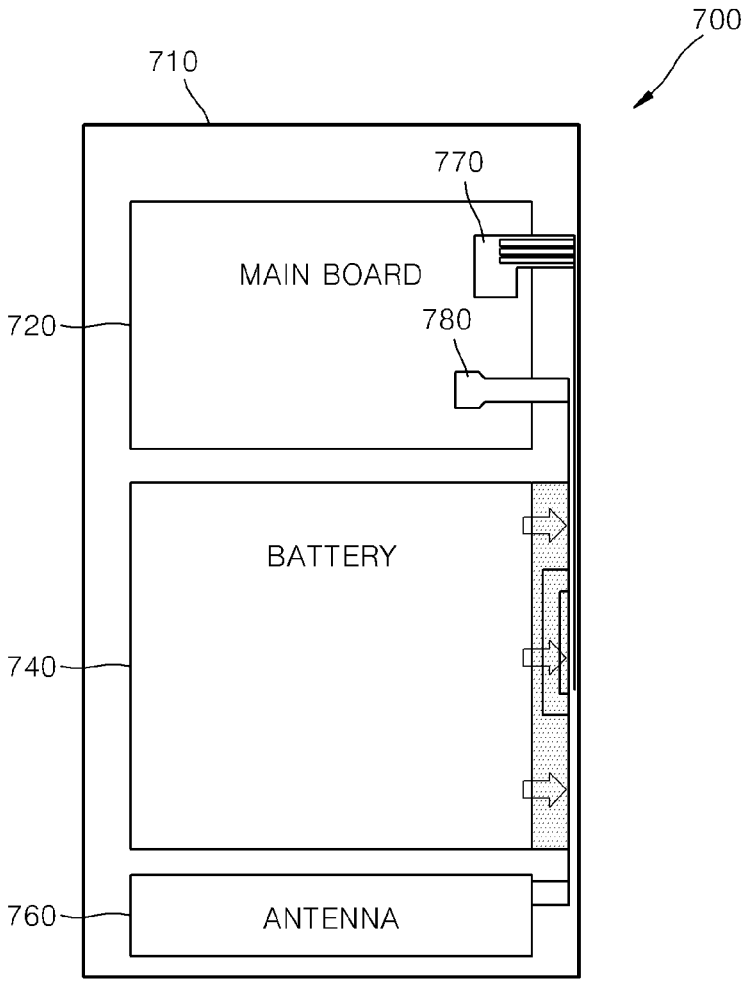
FIGS. 16A and 16B are a top view and a side view respectively illustrating an arrangement of a terminal installed with an FPCB formed with an HF communication line according to even another embodiment of the present invention.
Figure 16B:
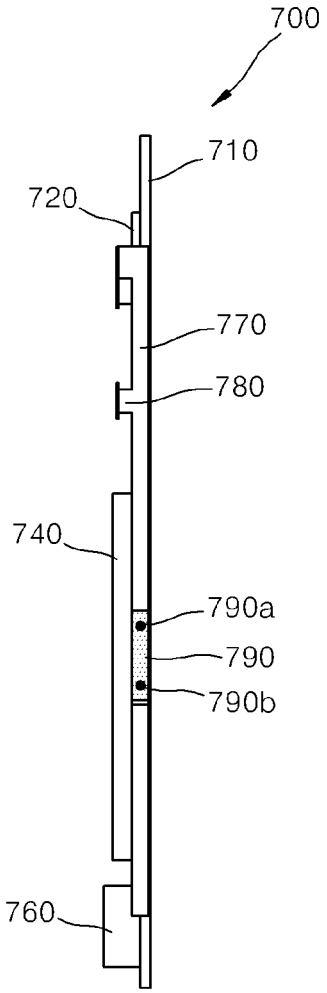

FIGS. 16A and 16B are a top view and a side view of a terminal 700 formed with an HF communication line according to even another embodiment of the present invention.

The terminal 700 includes a base board 710, a main board 720, a battery 740, an antenna 760, an FPCB 780, and an auxiliary FPCB 770.

Except the auxiliary FPCB 770 and the FPCB 780, the terminal 700 is identical to the terminals above. Accordingly, hereinafter, only the auxiliary FPCB 770 and the FPCB 780 will be described.

In the embodiment, instead of being configured on one FPCB, an HF communication line and a data communication line are formed on separate FPCBs.

That is, like the configuration above, the FPCB 780 has a connector bent and vertically standing. The connector is bent again at the right angle to be connected to the antenna 760. In this case, the auxiliary FPCB 770 for data communication has an auxiliary connector bent at the right angle and vertically standing. The auxiliary connector is disposed more outwards to be adjacent to a right wall plate of the base board 710 than the connector of the FPCB 780.

In this case, the auxiliary connector is extended toward an area of a keypad 790. Herein, particularly, a portion of the connector of the FPCB 780 overlapped with the area of the keypad 790 is to be disposed while being bent again at the right angle to be in surface-contact with the base board 710.

A reason thereof, when two films are disposed to be adjacent to each other and vertically stand, a first button 790*a* and a second button 790*b* of the keypad 790 are continuously being pushed, thereby wearing a corresponding portion of the FPCB 780 to be damaged.

In FIG. 16A, the corresponding portion is in surface-contact with the base board 710. However, the corresponding portion may be in contact with an upper board (not shown) covering the base board 710. Similarly, a first connection in contact with the main board 710 and a second connection in contact with the antenna 760 may also be connected to a bottom of the main board 720 or a top of the antenna 760.

Figure 17:
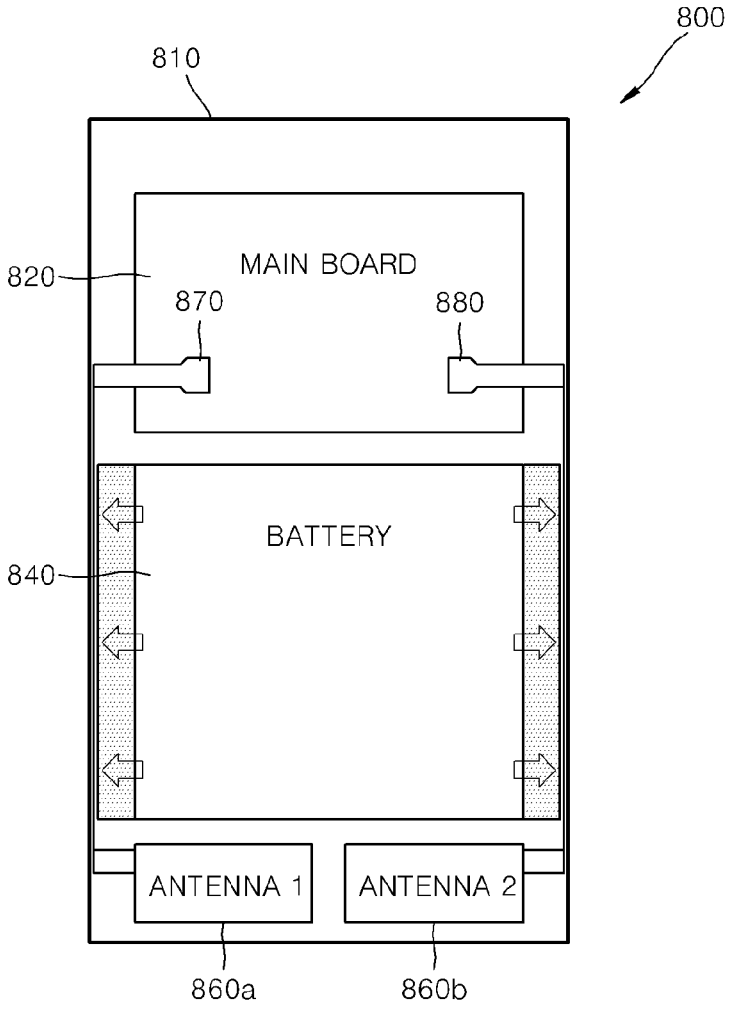
FIG. 17 is a top view illustrating an arrangement of a terminal installed with an FPCB formed with an HF communication line according to yet another embodiment of the present invention.

FIG. 17 is a top view of a terminal 800 installed with FPCBs formed with HF communication lines according to yet another embodiment of the present invention.

The terminal 800 includes a base board 810, a main board 820, a battery 840, a first antenna 860*a*, a second antenna 860*b*, a first FPCB 870, and a second FPCB 880.

Except the antennas 860*a* and 860*b* and the FPCBs 870 and 880, the terminal 800 is identical to the other terminals. Accordingly, hereinafter, only the antennas 860*a* and 860*b* and the FPCBs 870 and 880 will be described.

The terminal 800 uses two antennas to improve the performance of the same frequency or to transmit and receive two different frequencies. When two antennas are installed as described above, it is necessary to connect the respective antennas to HF communication lines. However, when using FPCBs as in the embodiment, the first FPCB 870 is connected to the first antenna 860*a* through a left side of the base board 810 and the second FPCB 880 is connected to the second antenna 860*b* through a right side of the base board 810, thereby minimizing thicknesses of HF communication lines in the left and right of the battery 840 to provide a maximum area for the battery 840.

Figure 18:
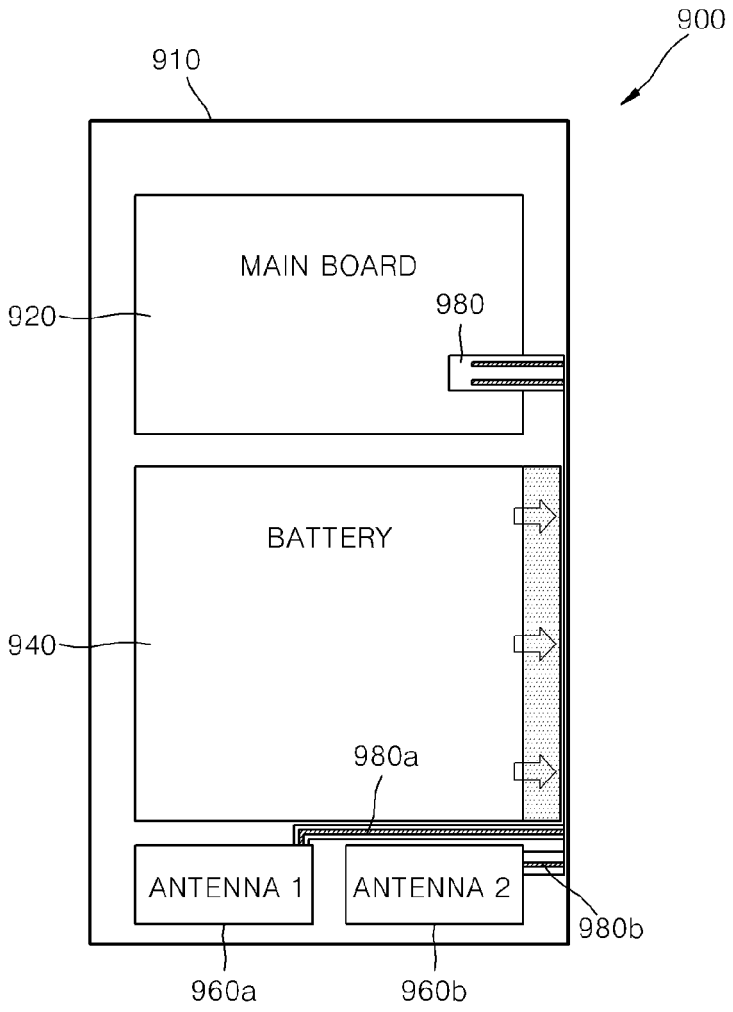
FIG. 18 is a top view illustrating an arrangement of a terminal installed with an FPCB formed with an HF communication line according to a further embodiment of the present invention.

FIG. 18 is a top view of a terminal 900 installed with an FPCB 980 formed with HF communication lines according to a further embodiment of the present invention.

The terminal 900 includes a base board 910, a main board 920, a battery 940, a first antenna 960*a*, a second antenna 960*b*, and the FPCB 980.

Except the FPCB 980, the terminal 900 is identical to the other terminals. Accordingly, hereinafter, only the FPCB 980 will be described.

Differing from the FPCBs 870 and 880, in the FPCB 980 of the terminal 900, instead of separately forming HF communication lines connected to two antennas, the one FPCB 980 is connected to the main board 920 through a first connection and connected to the first antenna 960*a* and the second antenna 960*b* through two separate second connections.

That is, two HF communication lines 980*a* and 980*b* are formed in the FPCB 980. A first HF communication line 980*a* is connected o the first antenna 960*a* and a second HF communication line 980*b* is connected o the second antenna 960*b*.

When forming as described above, not only the cost may be described but also, since an area for a thickness of only one film is occupied, a more area for the battery 940 may be provided.

Figure 19A:
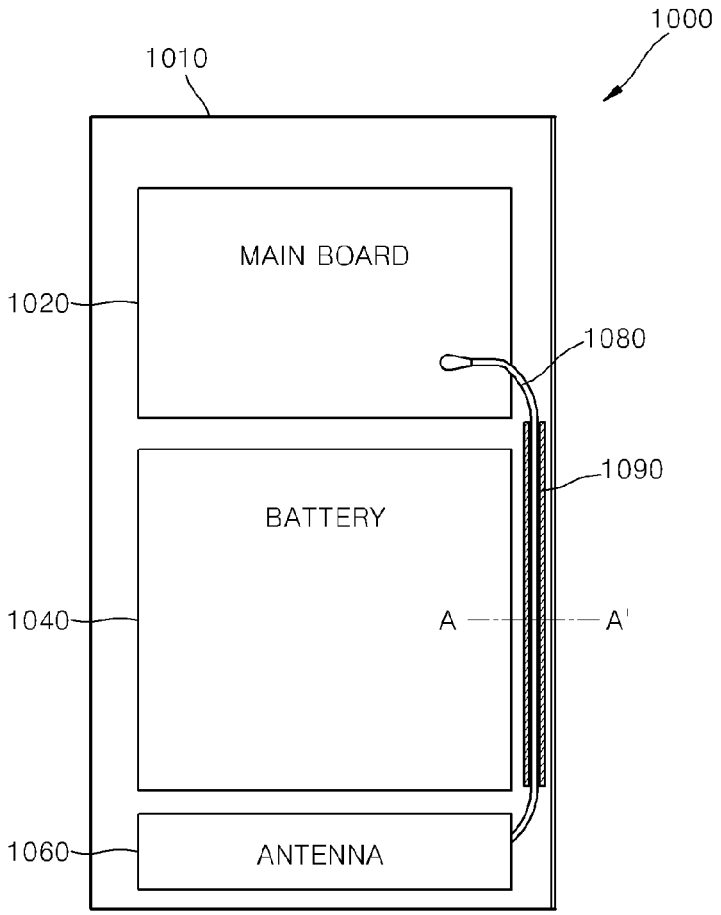
FIG. 19A is a top view of an arrangement of a general terminal installed with a cable-type RF communication line.
Figure 19B:
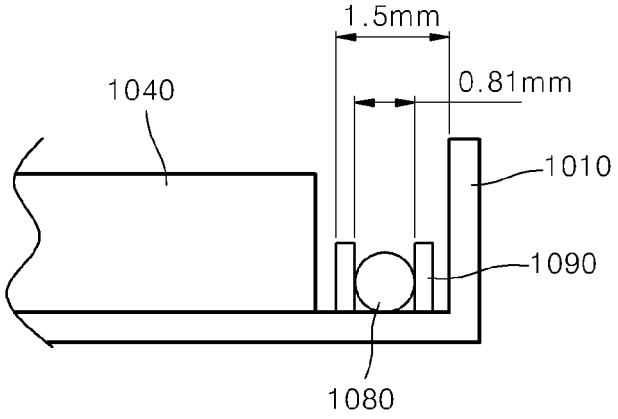
FIG. 19B is a cross-sectional view illustrating a part taken along a line A-A' shown in FIG. 19A.

FIG. 19A is a top view of an arrangement of a general terminal 1000 installed with a cable-type RF communication line, and FIG. 19B is a cross-sectional view illustrating a part taken along a line A-A' shown in FIG. 19A.

When having a structure shown in FIG. 19A, in the part A-A', as shown in FIG. 19B, an area for a battery 1040 may be reduced as about 0.81 mm, a thickness of an RF communication cable 1080. Considering a thickness of a fixation frame 1090, the area for the battery 1040 may decrease as about 1.5 mm. Currently, in the field of smart phones, it is important to increase the duration of using a smart phone by maximizing the capacity of a battery. In this case, it may be a big loss not to provide the thickness described above as an area of the battery.

Figure 20A:
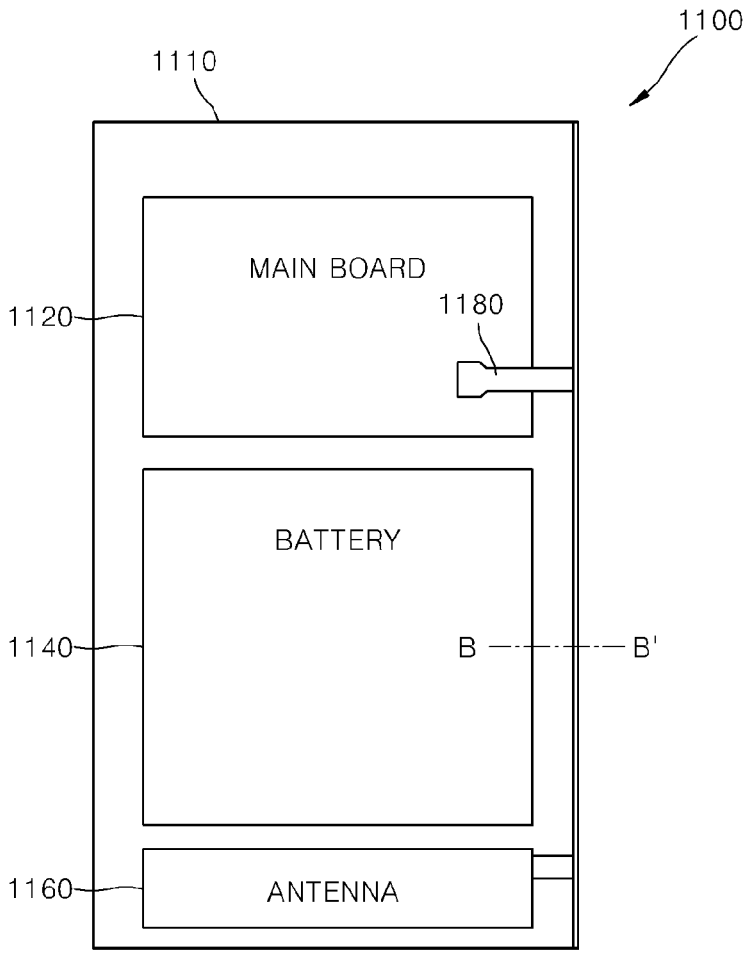
FIG. 20A is a top view of an arrangement of a terminal installed the HF communication line as shown in FIG. 2A.
Figure 20B:
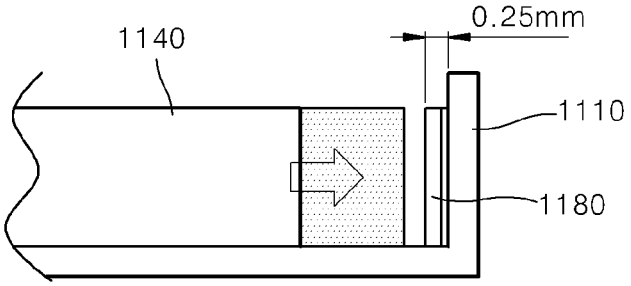
FIG. 20B is a cross-sectional view illustrating a part taken along a line B-B' shown in FIG. 20A.

FIG. 20A is a top view of an arrangement of a terminal 1100 having the same configuration as the terminal 200 installed the HF communication line shown in FIG. 2A, and FIG. 20B is a cross-sectional view illustrating a part taken along a line B-B' shown in FIG. 20A.

Since, the structure of the terminal 110 of FIG. 20A is identical to that of the terminal 200, a detailed description will be omitted.

In the part B-B', since a thickness of an FPCB 1180 is just about 0.25 mm, comparing with FIG. 20B, an area of about 1.25 mm may be further provided for an area of a battery 1140.

Figure 21A:
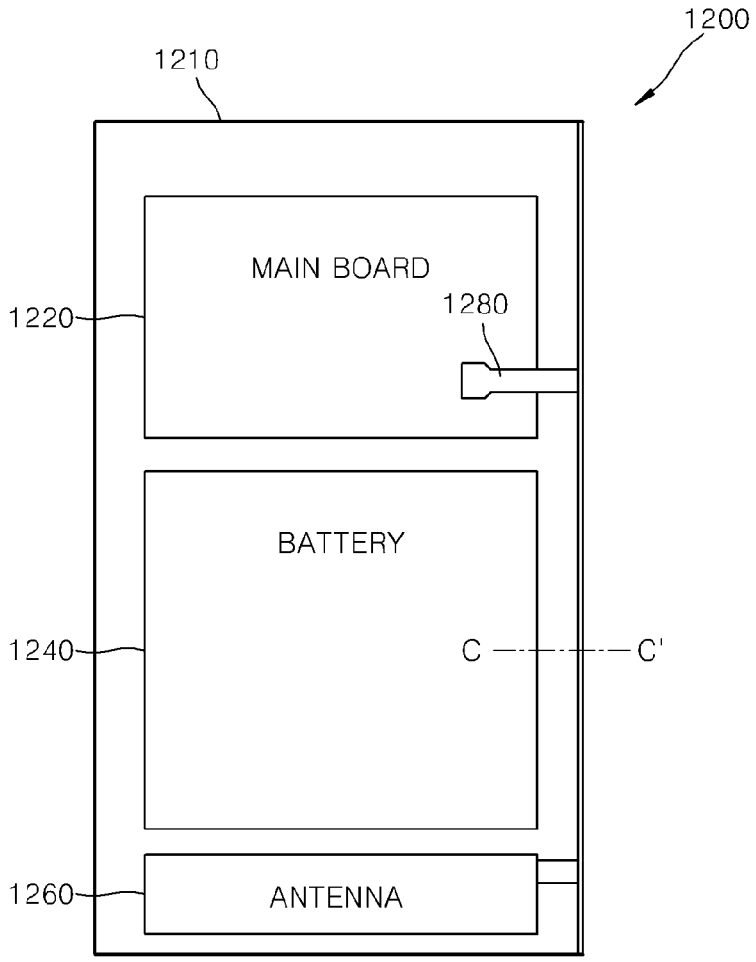
FIG. 21A is a top view of an arrangement of a terminal installed the HF communication line according to a still further embodiment of the present invention.
Figure 21B:
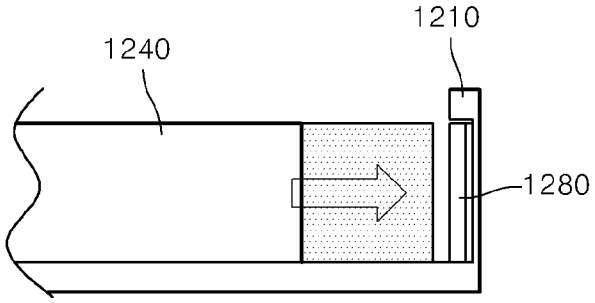
FIG. 21B is a cross-sectional view illustrating a part taken along a line C-C' shown in FIG. 21A.

FIG. 21A is a top view of an arrangement of a terminal 1200 installed the HF communication line according to a still further embodiment of the present invention, and FIG. 21B is a cross-sectional view illustrating a part taken along a line C-C' shown in FIG. 21A.

The terminal 1200 is identical to the terminal 1000 of FIG. 19A except a connector of an FPCB 1280 inserted into a groove provided on a wall plate of a base board 1210.

That is, referring to FIG. 21B, on the wall plate of the base board 1210, the groove having a rectangular shape is provided to allow the connector to be inserted thereinto. In this case, an area for a battery 1240 may be more provided than that of FIG. 20B.

Figure 22:
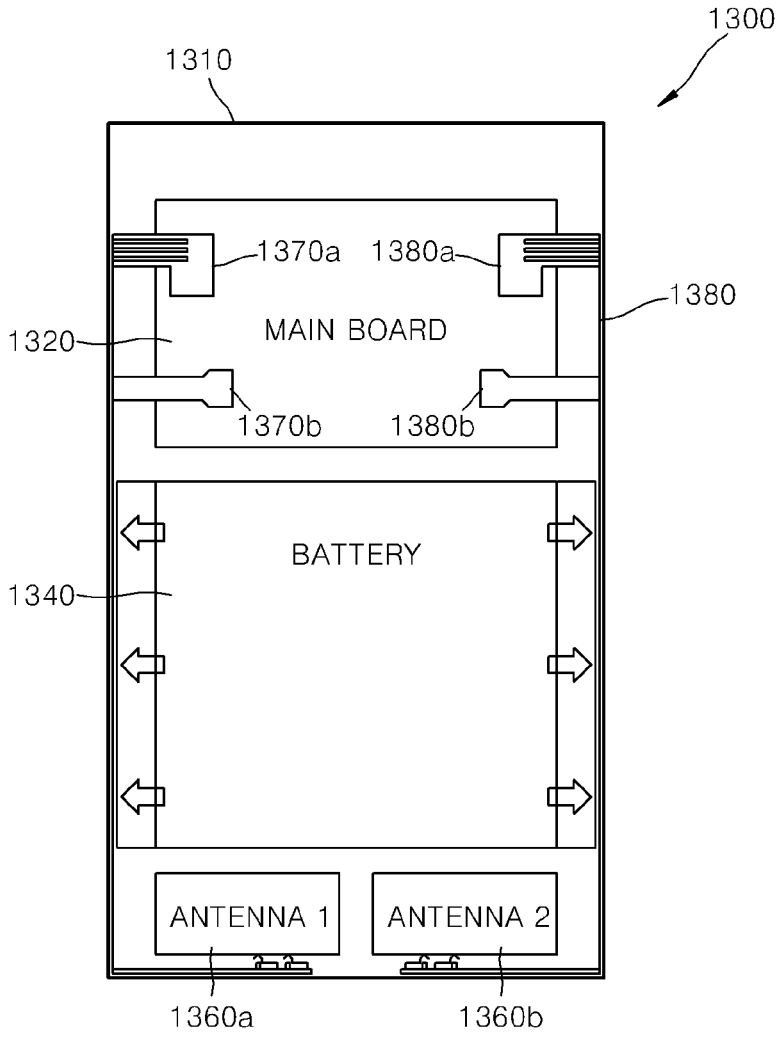
FIG. 22 is a top view illustrating an arrangement of a terminal installed with an FPCB formed with an HF communication line according to an even further embodiment of the present invention.

FIG. 22 is a top view illustrating an arrangement of a terminal 1300 installed with an FPCB formed with an HF communication line according to an even further embodiment of the present invention.

The terminal 1300 is identical to the terminal 800 of FIG. 16A except configuring a first connection formed as two separate ones and a second connection formed as a C-Clip type.

That is, a first FPCB 1370 includes a first connection 1370*a* connected with a data communication line and a second connection 1370*b* connected with an HF communication line. A second FPCB 1380 includes a first connection 1380*a* connected with a data communication line and a second connection 1380*b* connected with an HF communication line.

The second connection 1370*b* and 1380*b* is formed as the C-Clip type. In this case, since being connected to a bottom of an antenna, it is unnecessary to bend a connector to be in contact with a base board 1310. However, the connector may be bent at the right angle and extended adjacently to a lower wall plate of the base board 1310 to be connected to bottoms of antennas 1360*a* and 1360*b*.

As described above, according to the one or more of the above embodiments of the present invention, As described above, according to the one or more of the above embodiments of the present invention, space availability of a limited internal space of a mobile communication terminal may increase and costs for manufacturing lines may be reduced by using an FPCB formed with an HF transmission line.

Particularly, the terminal provides a maximum space for a battery by arranging an FPCB formed with one of an HF transmission line and a data communication line on a side of the terminal, thereby maximizing capacity of the battery.

Also, in general, it is impossible to configure a communication line by using a coaxial cable in a small internal space of a wireless device. However, the communication line may be configured using an FPCB.

Also, since having a circular shape with an uneven surface, a coaxial cable is attached by using an additional fixation frame instead of easily fixing using adhesives. However, having a flat surface, an FPCB may be easily fixed using adhesives such as a double-sided adhesive tape, thereby reducing the speed of production and reducing manufacturing costs.

It should be understood that the exemplary embodiments described therein should be considered in a descriptive sense only and not for purposes of limitation. Descriptions of features or aspects within each embodiment should typically be considered as available for other similar features or aspects in other embodiments.

While one or more embodiments of the present invention have been described with reference to the figures, it will be understood by those of ordinary skill in the art that various changes in form and details may be made therein without departing from the spirit and scope of the present invention as defined by the following claims.

What is claimed is:

1. A terminal comprising:

a base board comprising a flat plate and a wall plate vertically projected from left, right, top, and bottom edges of the flat plate;

a first object disposed on the base board;

a second object disposed on the base board;

a battery disposed between the first object and the second object on the base board and supplying power to the terminal; and a flexible printed circuit board (FPCB) connected between the first object and the second object for signal transmission therebetween, wherein the FPCB comprises:

a first connection formed on one end thereof and electrically connected to the first object;

a second connection formed on another end thereof and electrically connected to the second object; and a connector connecting the first connection with the second connection, wherein the connector is disposed to vertically stand between the battery and the wall plate of the base board.

2. The terminal of claim 1, wherein the connector comprises a first bent portion bent at a portion connected to the first connection and a second bent portion bent at a portion connected to the second connection to be allowed to be bent at the right angle with the first connection and the second connection.

3. The terminal of claim 2, wherein the first bent portion and the second bent portion of the FPCB are formed to have smaller thicknesses than other areas of the FPCB.

4. The terminal of claim 1, wherein the first object is one of a main board and a sub-board disposed on the base board and controlling operations of the terminal, and wherein the second object is one of an antenna disposed on the base board and transmitting and receiving a wireless communication signal and the main board and the sub-board controlling the operations of the terminal.

5. The terminal of claim 4, wherein the FPCB is connected between the first object and the second object and is formed with a high frequency (HF) communication line for radio frequency (RF) communication.

6. The terminal of claim 4, wherein the antenna is configured to be separated into a first antenna and a second antenna, and wherein the FPCB is separated into a first FPCB connected to the main board and the first antenna and a second FPCB connected to the main board and the second antenna to be paired.

7. The terminal of claim 4, wherein the antenna is configured to be separated into a first antenna and a second antenna, and wherein the second connection is formed to be separated into a second-A connection connected to the first antenna and a second-A connection connected to the second antenna.

8. The terminal of claim 4, wherein the second connection is connected to the antenna in a manner of a C-Clip type.

9. The terminal of claim 1, wherein the FPCB is further formed with a data communication line for data communication.

10. The terminal of claim 9, wherein the connector is further formed with a keypad connected to the data communication line.

11. The terminal of claim 9, wherein the first connection is formed to be divided into a first-A connection formed with the HF communication line and a first-B connection formed with the data communication.

12. The terminal of claim 1, further comprising an auxiliary FPCB connected to the first object and formed with a data communication line for data communication, wherein the auxiliary FPCB comprises:

an auxiliary connection formed on one end and electrically connected to the first object; and an auxiliary connector connected to the second connection, wherein the auxiliary connector comprises an auxiliary bent portion bent at a portion connected to the auxiliary connection and is disposed to be bent at the right angle with the auxiliary connection and to vertically stand between the battery and the wall plate of the base board.

13. The terminal of claim 12, wherein a keypad connected to the data communication line formed on the auxiliary FPCB is formed on an end of the auxiliary connector, and wherein a hole for exposing the keypad is formed on a portion of the wall plate corresponding to a location in which the keypad is formed.

14. The terminal of claim 13, wherein the connector and the auxiliary connector are disposed on a side of the base board to vertically stand between the battery and the wall plate while the auxiliary connector is being disposed more outwards toward the wall plate, and wherein a portion of the connector corresponding to an area in which the keypad is formed is disposed to be bent at the right angle and is in surface-contact with the base board.

15. The terminal of claim 14, wherein the portion of the connector corresponding to the area, in which the keypad is formed, and bent at the right angle is formed to have a smaller thickness than other areas of the connector.

16. The terminal of claim 1, wherein a groove having a rectangular shape to allow the connector to be contained therein is further formed in an area of the wall plate of the base board, disposed in a direction, in which the connector is disposed.

* * * * *